US005535089A

United States Patent [19]

Ford et al.

[11] Patent Number: 5,535,089

[45] Date of Patent: Jul. 9, 1996

[54] IONIZER

[75] Inventors: Joseph E. Ford, Cary; Ronald O. Hilger, Elmhurst, both of Ill.; Raymond Chan, Vancouver, Canada

[73] Assignee: Jing Mei Industrial Holdings, Ltd., Hong Kong, Hong Kong

[21] Appl. No.: 323,751

[22] Filed: Oct. 17, 1994

[51] Int. Cl.[6] ..... H01T 23/00

[52] U.S. Cl. ..... 361/231; 361/230

[58] Field of Search ..... 361/213, 229, 361/230, 231, 212, 220, 222; 55/392, 393, 400, 467, DIG. 1

[56] References Cited

U.S. PATENT DOCUMENTS

| | | | |
|---|---|---|---|
| Re. 34,346 | 8/1993 | Foster, Jr. et al. | 361/231 |
| 4,227,894 | 10/1980 | Proynoff | 55/126 |
| 4,376,642 | 3/1983 | Verity | 55/105 |
| 4,380,720 | 4/1983 | Fleck | 315/111.91 |
| 4,643,745 | 2/1987 | Sakakibara et al. | 55/137 |
| 4,713,724 | 12/1987 | Voelkel | 361/231 |
| 4,811,159 | 3/1989 | Foster, Jr. | 361/231 |
| 5,055,963 | 10/1991 | Partridge | 361/231 |
| 5,153,811 | 10/1992 | Rorigo et al. | 361/231 |

FOREIGN PATENT DOCUMENTS

| | | | |
|---|---|---|---|
| A-61090/90 | 8/1990 | Australia | B03C 3/38 |
| 0558090A2 | 9/1993 | European Pat. Off. | B03C 3/38 |
| 2117676 | 10/1983 | United Kingdom | B03C 3/32 |

*Primary Examiner*—Fritz M. Fleming
*Attorney, Agent, or Firm*—Thomas W. Tolpin

[57] ABSTRACT

Sootless ionizers are provided which greatly reduce the accumulation of ugly black soot on and about the ionizers and adjacent walls or ceiling in the room in which the air is being purified. To this end, the dependable improved ionizers are specially arranged to provide air channels which direct the flow of air past the needles or other ion emitters so that the ions are dispersed through the room for enhanced air purification and the ionized particles are prevented (blown away) from being collected in the ionizers. In one embodiment, the improved ionizers include a plug-in ionizer (PI-1) with an upwardly converging air channel, a curved deflector, and upper and lower sets of air channeling ribs to direct the flow of air past the ion emitters and way from the ionizers. In a second embodiment, the improved ionizer comprises a plug-in ionizer (PI-2) which is similar to the first plug-in ionizer (PI-1) except that it has a single elongated set of air channeling ribs and a motor driven fan to increase air flow. In a third embodiment, the improved ionizers comprise an industrial ionizer with air channeling ribs to direct the flow of air past the ion emitters and away from the ionizers. The industrial ionizer is equipped with an ionizer circuit that substantially decreases or eliminates ammonia type gases in agricultural and industrial environments which provides a safer and healthier environment to work and live in.

12 Claims, 4 Drawing Sheets

IONIZER

BACKGROUND OF THE INVENTION

This invention pertains to air purifiers and, more particularly, to ionizers.

Over the years, many types of air purifiers and dedusters have been provided to purify and dedust air. Ionizers are particularly helpful. An ionizer is a device which emits electrically charged ions that clean impurities from the air and provides a feeling of well being to the user. Where possible, the ionizer should accomplish its purpose without creating an amount of ozone which is harmful, to people, pets, and plants. One particularly useful type of prior art ionizer is described in Reissue U.S. Pat. Re. No. 34,346, reissued Aug. 17, 1993, in which one of the coinventors, Ronald O. Hilger is a coinventor of the subject patent application.

Conventional prior art ionizers typically have sharp needles or pointed wires which emit electrons (ions) produced by high voltage pulses to ionize the air. The sharp needles and pointed wires can puncture and severely cut the hand of a consumer or installer.

Conventional prior art ionizers also typically have internal or external collector pads which collects and accumulates ionized particles. As a result, conventional prior art ionizers and their surroundings, including walls, drapes and furniture, often get covered with ugly blotches of soot, debris and dirt formed by the collected black ionized particles, dust and agglomerated fine carbon particulates.

It is, therefore, desirable to provide improved ionizers which overcome most, if not all, of the above problems.

SUMMARY OF THE INVENTION

Convenient user-friendly ionizers are provided to purify air and greatly reduce blotches of ugly black soot, debris and dirt formed by ionized particles, dust and agglomerated fine carbon particulates, from collecting on and about the ionizers, adjacent walls, ceiling, drapes and furniture. The environmentally correct, consumer responsive, beneficial ionizers provide much cleaner air and a healthier environment for people, pets and plants. The safe dependable ionizers protect customers and installers repairman by providing a needle guard which prevents the sharp needles and points of the ion emitters from cutting, puncturing or otherwise hurting people's fingers and hands. Advantageously, the attractive, skillfully crafted ionizers are economical, easy to use, simple to install, durable, efficient, and effective.

To this end, the cost effective, well built ionizers have an ion emission assembly, including ion emitting needles, wires, pins or other ion emitters, powered by an ionizing circuit, to emit electrons (ions) in order to ionize the air in a room and the pollutants and contaminants carried by the air such as dust (dust laden particles) and particulates of dirt. A housing assembly safely encloses and supports the ion emitters and ionizing circuit to prevent the high voltage ionizing circuit from being accidentally touched, tampered with or moisture from entering therein.

Advantageously, the novel ionizers has air channeling deflectors and flow enhancers which provide a cleaning assembly to substantially prevent the accumulation of soot, dirt, debris and ionized dust laden particles about the housing and ionizer, as well as on adjacent walls, ceiling, drapes, furniture, etc., by channeling, circulating and ventilating air past the ion emitters and directing the flow of ions away from the ionizer and the surface upon which the ionizer is mounted. In the preferred form, the ionizers have air channels which direct the flow (circulation) of air past the needles or other ion emitters so that the ions are dispersed throughout the room for enhanced air purification and the ionized particles are prevented (blown away) by the flowing air from being collected in and about the ionizers.

In one embodiment, the ionizers include a plug-in ionizer (PI-1) with an upwardly diverging air channel, a curved deflector, and upper and lower sets of air channeling ribs to direct the flow of air past the ion emitters and away from the ionizers. The plug-in ionizer has a pair of contact blades which plug into an electrical wall outlet. Ambient air flows through the ionizer unit by natural circulation. Air enters the plug-in ionizer through ribbed openings at the bottom of the ionizer and flows around the ionizing (ion-emitting) needles where the air is mixed with the ions. The air mixed with the ions is deflected by a curved deflector of the upper housing through a ribbed outlet opening into the room and away from the ionizer to help keep the walls clean. The air channeling ribs are positioned in proximity to the upwardly diverging air channel and are multi-functional. The ribs direct the flow of air around the ionizing needles. The ribs provide a guard and safety protector for the ionizing needles. The ribs also support the cover. The cross sectional area of the entrance (inlet) of the upwardly converging air channel has a greater cross sectional area than the exit (outlet) of the air channel to increase the speed and flow rate of the air past the ion emitters (needles).

In a second embodiment, the improved ionizer comprises a plug-in ionizer (PI-2) which is similar to the first plug-in ionizer (PI-1) except that it has a single elongated set of air channeling ribs and a motor driven fan (blower) to increase air flow past the ionizing needles where the air is mixed with the ions and blown into the room where the plug-in ionizer is located.

In a third embodiment, the improved ionizers comprise an industrial ionizer with air channeling ribs to direct the flow of air past the ion emitters (needles) and away from the ionizers. The industrial ionizers provides a stationary fixture which is designed to be hard wired to an electrical outlet box in a ceiling or wall. The industrial ionizer is also useful to decrease the ammonia level in chicken houses and other animal houses to promote healthier chickens and other animals.

A more detailed explanation of the invention is provided in the following description and claims taken in conjunction with the accompanying drawings.

DETAILED DESCRIPTION OF THE PREFERRED EMBODIMENTS

Figure 1:
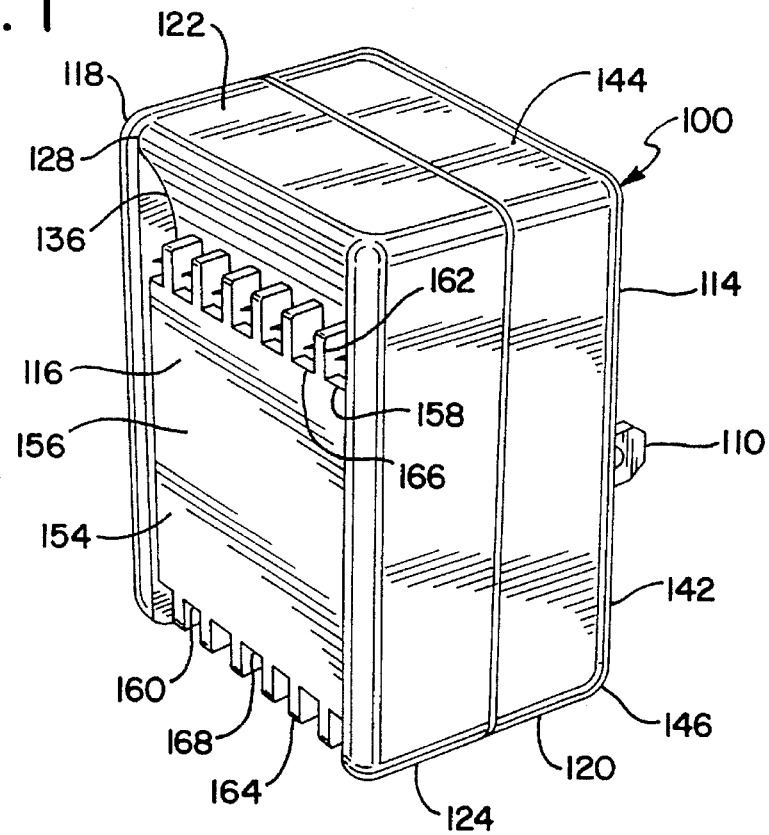
FIG. 1 is a perspective view of a plug-in ionizer (PI-1) in accordance with principles of the present invention.
Figure 2:
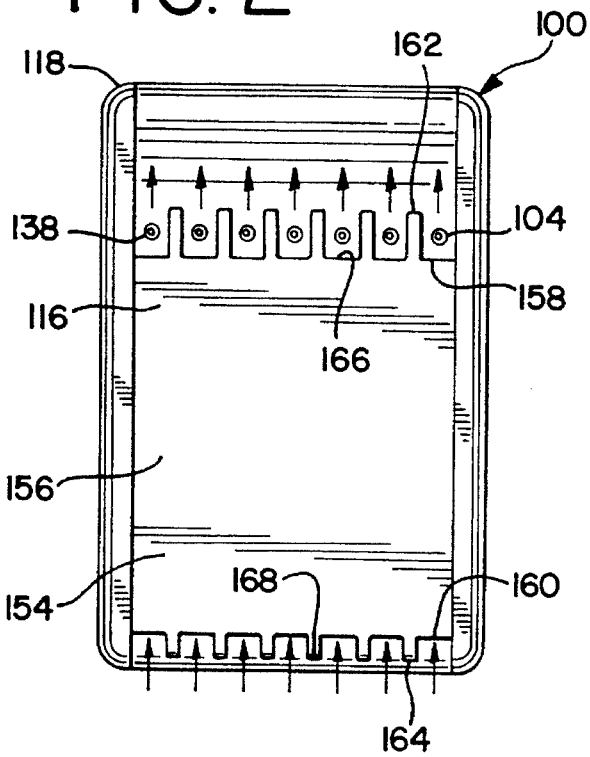
FIG. 2 is a front view of the plug-in ionizer (PI-1)
Figure 3:
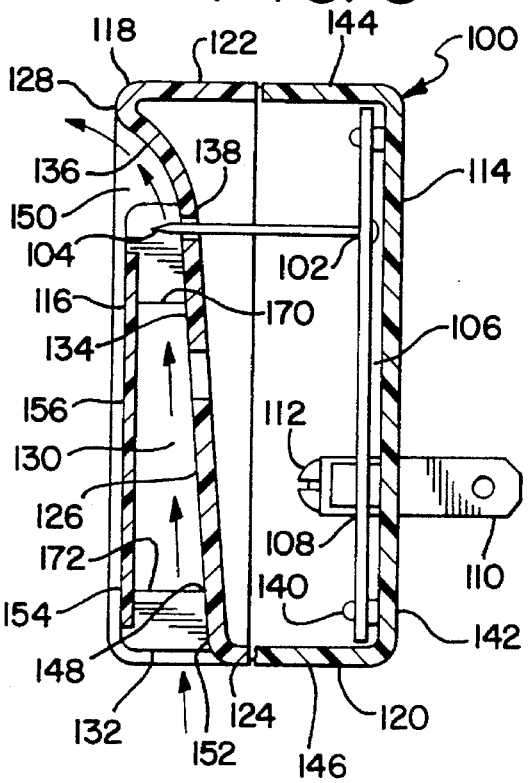
FIG. 3 is a cross-sectional side view of the plug-in ionizer (PI-1)

FIGS. 1–3 illustrates a user-friendly device, light weight apparatus and small personal appliance which comprises a compact, convenient portable, plug-in ionizer (PI-1) 100 which can be held in the palm of a hand and plugs into an electrical power wall outlet of an upright wall in a room. The plug-in ionizer is connected to and cantilevered from the wall outlet. The ionizer purifies, cleanses and dedusts airborne particulates from the air so as to substantially decrease the amount of concentration of dusty particulates (dust laden particles) and pollutants in the air of the room the ionizer is plugged in so as to make the air in the room fresher, cleaner, healthier, more breathable and comfortable for persons, plants, pets and animals in the room. Desirably, the ionizer greatly reduces the accumulation of dirt, soot, debris and ionized particles on the wall, ceiling, floor, carpet and furniture in the room. The plug-in ionizer 100 has an internal ion emission assembly 102 (FIG. 3) which generates and emits negatively charged ions to ionize the air and dusty airborne particulates, contaminants and pollutants in the air. The ion emitting assembly 102 has a set, series and array of ion emitters comprising of ion-emitting metal ionizing needles 104. The needles 104 can be gold or nickel plated and/or made of stainless steel. The needles 104 are self-secured or can be supported by and cantilevered from a circuit board 106. The needles 104 can be electrically connected to an electric drive circuit 108 mounted on the circuit board 106. The electric drive circuit can be of the type shown in Reissue Patent Re. 34,346 entitled Ionizer, by inventor Robert W. Foster, Jr. and Ronald O. Hilger (the coinventor of the present application), reissued Aug. 17, 1993, which is herein incorporated by reference. The electric drive circuit cyclically applies a negative potential charge and drive pulses to the needles 104 at a sufficiently high voltage to ionize the particulates of dust and other pollutants in the air without substantially generating ozone. Other electric drive circuits can be used, if desired, to accomplish the same results. A pair of electrical power plug contact blades 110 are connected to the electrical circuit via screws or other means 112 and extend through opening in the circuit board 106 to connect and plug into an electrical wall outlet, such as at the base of an upright vertical wall. If desired, a three prong electrical power plug can be used.

The plug-in ionizer 100 has small and light weight housing and cover assemblies 114 and 116 that can be made of rigid impact-resistant insulating plastic. The housing assembly 114 partially encloses and supports the ion emission assembly. More specifically, the housing assembly 114 fully encloses the ion emission assembly except for the contact blades 110 and the tips of the needles 104. In the illustrative embodiment shown in FIG. 3, the housing assembly 114 has an upper top housing 118 and a lower bottom housing 120. The upper top housing 118 has a generally planar or flat top 122 and bottom 124 which extends between and is integrally connected to an upwardly inclined, elongated slanted front 126. The top 122 extends rearwardly from an upper rounded corner (shoulder) 128 of the front 126. The bottom 124 has a cutaway portion 130, which extends forwardly of the front, and provides a downwardly facing entrance passageway (inlet) and air intake 132 for ingress of ambient air.

To enhance air flow past the needles and away from the ionizer 100, the upwardly inclined front 126 (FIG. 3) of the upper top housing 118 extends upwardly and forwardly from the bottom 124 of the upper top housing 118 at an obtuse angle of inclination ranging from 95–150 degrees, preferably from 95–105 degrees. Desirably, the front 126 of the upper top housing 118 provides an air deflector with an elongated slanted portion 134 that extends upwardly and outwardly (forwardly) and a concave arcuate curved upper portion 136. The upper section of the slanted portion 134, adjacent the curved portion 136, has a horizontally aligned set of emission apertures 138 which provide needle-receiving holes through which extend the tips of the needles 104. The curved portion 136 provides an arcuate concave deflector which directs the ions and air away from the ionizer 100, needles 104 and wall to which the ionizer 100 is plugged in, to substantially prevent the accumulation of debris, dirt and soot comprising ionized particulates on the wall and ionizer 100.

The bottom lower housing 120 (FIG. 3) encloses and may be solvent welded to the upper housing 118. The pins in the lower housing 120 position the PC board 106 away from and provide clearance for solder connections of components on the board 106. The entire high voltage circuit is potted with electrical grade potting compound. In use, the bottom lower housing 120 is positioned adjacent to and faces the wall outlet of the upright wall. The lower bottom housing 120 has an elongated upright vertical back 142 with openings through which the contact blades 110 extend. Horizontal top and bottom portions 144 and 146 extend forwardly from the back 142 and are in coplanar alignment with and connected to the top 122 and bottom 124, respectively, of the upper top housing 118.

The cover assembly 116 and the upper top housing 118 cooperate with each other to provide an upwardly converging tapered air channel 148 (FIG. 3) with a forwardly facing, upwardly inclined, upper exit passageway (outlet) 150 for channeling and directing flow of air past the needles 104 and away from the ionizer 100. The cross sectional area of the lower entrance (inlet) 152 of the air channel 148 is substantially larger than the upper exit (outlet) 150 of the air channel 148 to increase the speed and flow rate of the air past the needles 104. The rapid air flow from the air channel 148 directs and disperses the ions away from the ionizer 100 and helps reduce accumulation of dirt, dust, debris, and soot comprising ionized particles from accumulating on and near the ionizer 100, as well as on the walls and other objects in the room.

The cover assembly 116 (FIGS. 1–3) has an upright vertical cover 154 that is shorter than the front 126 (FIG. 3) of the upper top housing 118. The cover 154 has a generally planar or flat front main exterior surface 156 with upper and lower edges 158 and 160. The cover 154 also has a vertically aligned series and sets of parallel, vertical upright support air-channeling ribs 162 and 164 which provide air deflecting vanes. The ribs include upper and lower sets of vertical ribs. The upper set of ribs 162 are spaced vertically above the lower set of ribs 164. The upper set of ribs 162 extend vertically upwardly from and cooperate with the upper edges 158 of the front main surface 156 to provide upper U-shaped air channels 166 at the exit passageway (outlet). The lower set of ribs 164 extend vertically downwardly from and cooperate with the lower edges 160 of the front main surface to provide lower inverted U-shaped air channels 168 at the entrance passageway (inlet). The upper and lower sets of ribs 162 and 164 extend vertically along and outwardly (forwardly) from the front main surface 156 of the cover. The upper ribs 162 extend longitudinally (vertically) upwardly from the upper edges 158 of the main cover surface 156 and provides the sides of the upper air channels 166. The lower ribs 164 extend longitudinally (vertically) downwardly from the lower edges 160 of the main cover surface 156 and provides the sides of the lower air channels 168. The lower ribs 164 extend vertically upwardly from a position slightly above the bottom level of the upper top housing. The upper ribs 162 extend vertically upwardly to an elevation slightly above the needles 104. The upper ribs 162 provide needle guards to substantially prevent the needles for puncturing human fingers and hands. The upper edges 158 of the main cover surface provide the lower portions of the upper U-shaped air channels 166 and are positioned slightly below the needles 104. The lower edges 160 of the main cover surface provide the upper portion of the lower inverted U-shaped air channels 168. The upper and lower U-shaped air channels help direct the flow of air and ions past the needles into the room and away from the ionizer. The cover assembly 116 (FIG. 3) has horizontal top and bottom engaging fingers portions 170 and 172 which extend rearwardly from the vertical cover surface and have rearwardly extending pins that securely engage pin-receiving portion of the upper top housing.

Figure 4:
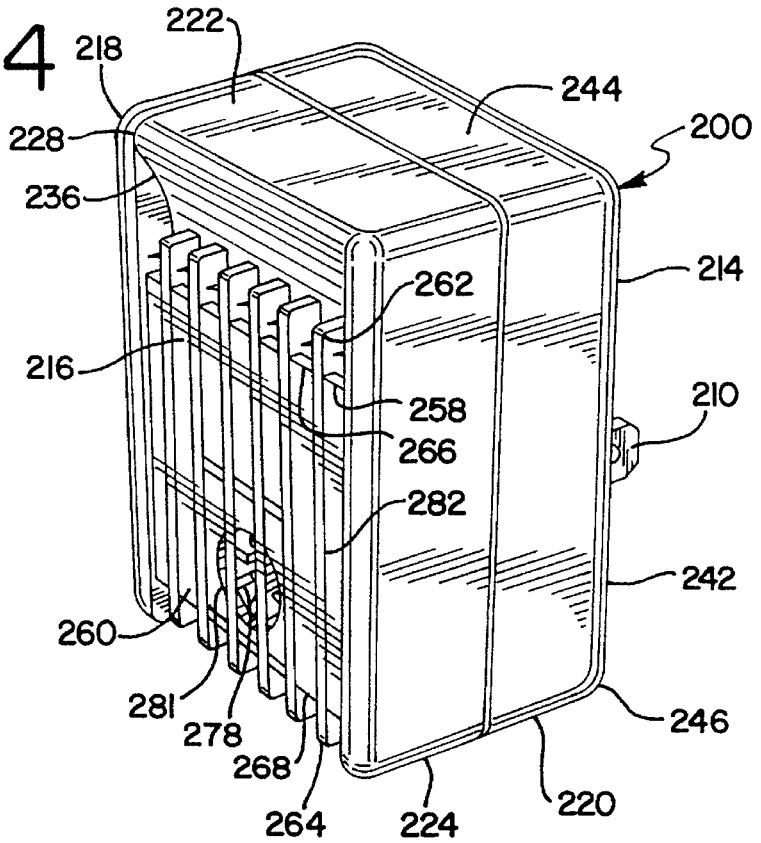
FIG. 4 is a perspective view of another plug-in ionizer (PI-2) in accordance with principles of the present invention.
Figure 5:
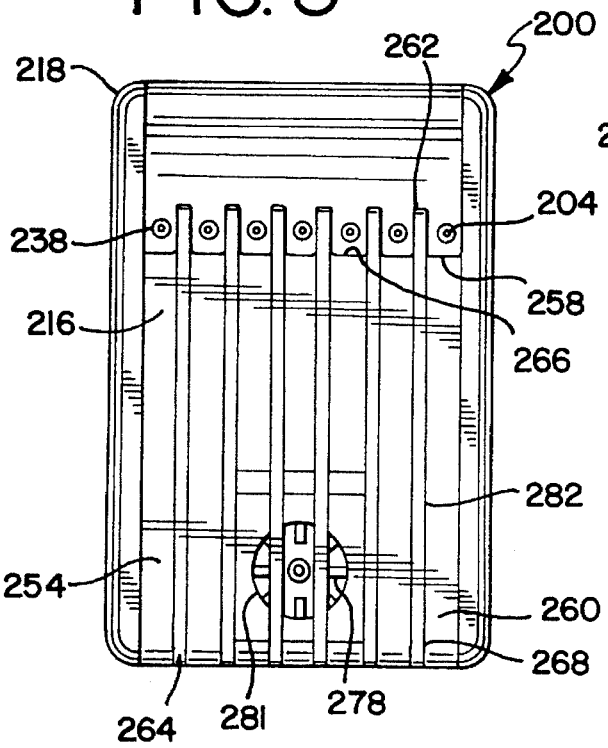
FIG. 5 is a front view of the plug-in ionizer (PI-2)
Figure 6:
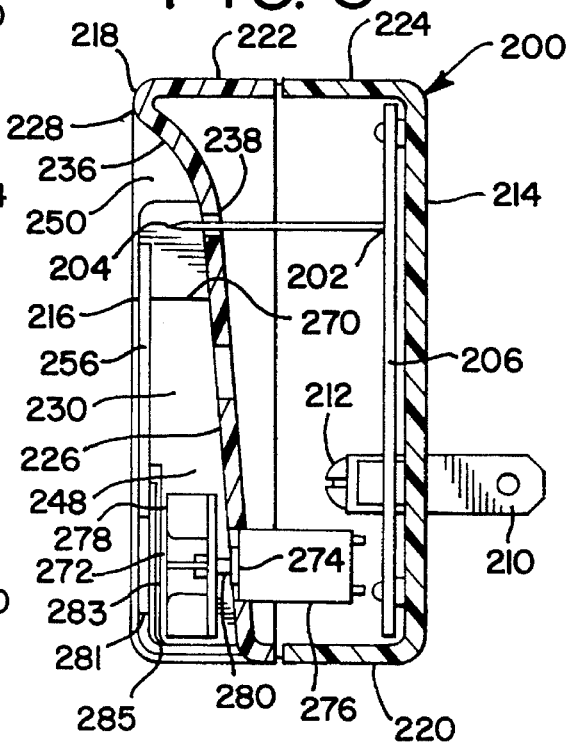
FIG. 6 is a cross-sectional side view of the plug-in ionizer (PI-2)

The hand held plug-in ionizer (PI-2) 200 of FIGS. 4–6 is structurally and functionally similar to the plug-in ionizer (PI-1) 100 of FIGS. 1–3, except as indicated below. For ease of understanding and clarity, the parts and components of the plug-in ionizer (PI-2) 200 have been given similar part numbers as the corresponding parts and components of the plug-in ionizer (PI-1) 100, except in the 200 series, such as contact blades 210, lower bottom housing 220, etc. The plug-in ionizer (PI-2) 200 has an air blower assembly 274 for drawing (sucking) air into the air channel. The blower assembly 274 has a direct current (DC) motor 276 which is self-secured or connected to the circuit board 206. The motor is connected to the electric drive circuit via a transformer. The motor is also positioned in the interior of the housing assembly 214. A blower wheel 278 comprising an upright power driven fan is connected to the motor shaft 280 and is driven by the motor 276. The fan 278 is disposed in the air channel 248 and is located just rearwardly of and in communication with an upright vertical, circular entranceway (hole) 281 in the lower upright portion of the cover. The entranceway 281 provides an air intake opening and inlet, through which ambient air is drawn and propelled into the air channel by the fan. A carbon impregnated filter 283 held by a hinged filter grill 285 is positioned between the fan 278 and the entranceway 281 to filter dust and debris from the influent (incoming) air. The filter grill 285 is hinged to the bottom front corner of the plug-in ionizer 200 and can pivot from a filtering position within the interior of the plug-in ionizer to an external position outside of the plub-in ionizer for cleaning and replacement of the filter 293.

Plug-in ionizer (PI-2) has a single elongated vertical set of upright air channeling ribs 282 which provide air deflecting vanes. The upper portions 262 of the ribs extend vertically upwardly from and cooperate with the upper edges 258 of the front main surface to provide upper U-shaped air channels 266 at the exit passageway (outlet). The lower portions 264 of the ribs extend vertically downwardly from and cooperate with the lower edges 260 of the front main surface to provide lower inverted U-shaped air channels 268 in proximity to the entrance passageway (inlet). The ribs 282 extend vertically along and outwardly (forwardly) from the front main surface of the cover 254. The upper portions 262 of the ribs extend longitudinally (vertically) upwardly from the upper edges 258 of the main cover surface and provides the sides of the upper air channels 266. The lower portions 264 of the ribs extend longitudinally (vertically) downwardly from the lower edges 260 of the main cover surface and provides the sides of the lower air channels 268. The lower portions 264 of the ribs extend vertically upwardly from a position slightly above the bottom level of the upper top housing. The upper portions 262 of the ribs extend vertically upwardly to an elevation slightly above the needles 204. The ribs 282 provide needle guards to substantially prevent the needles from puncturing human fingers and hands. The upper edges 258 of the main cover surface provide the lower portions of the upper U-shaped air channels 266 and are positioned slightly below the needles 204. The lower edges 260 of the main cover surface provide the upper portion of the lower inverted U-shaped air channels 268. The upper and lower U-shaped air channels help direct the flow of air and ions past the needles 204 into the room and away from the ionizer. The cover assembly has horizontal top and bottom engaging fingers portions 270 and 272 which extend rearwardly from the vertical cover surface and have rearwardly extending pins that securely engage pin-receiving portion of the upper top housing.

Figure 7:
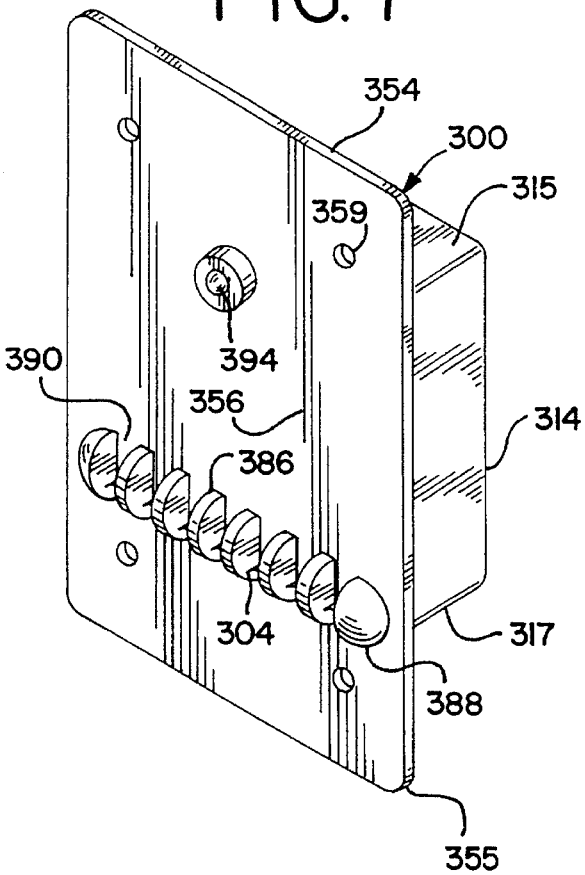
FIG. 7 is a perspective view of an industrial ionizer in accordance with principles of the present invention.
Figure 8:
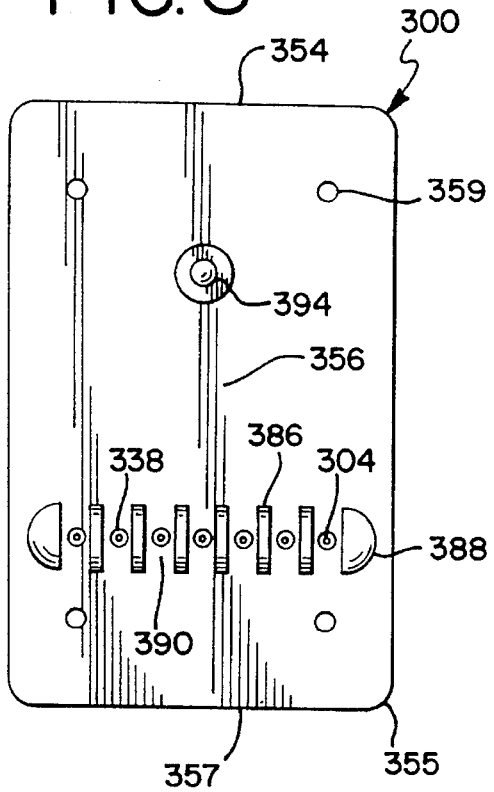
FIG. 8 is a front view of the industrial ionizer.
Figure 9:
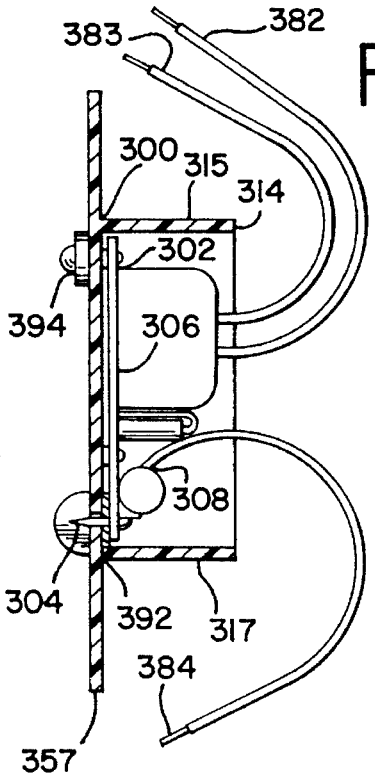
FIG. 9 is a cross-sectional side view of the industrial ionizer.
Figure 10:
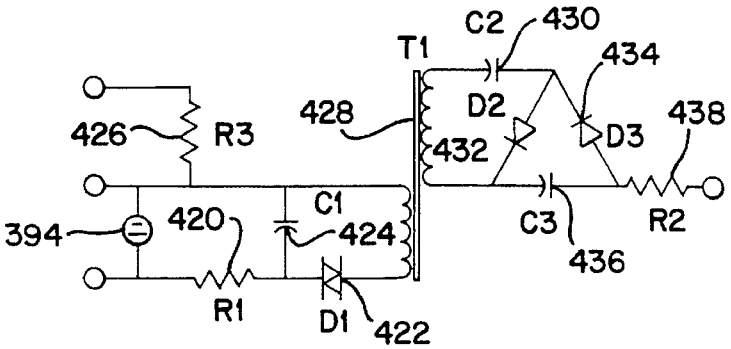
FIG. 10 is an electric drive circuit for the industrial ionizer.

FIGS. 7–9 illustrates a user-friendly device, fixture, appliance and apparatus which comprises a stationary commercial industrial ionizer 300 that is securely mounted and hard wired to a ceiling, overhead beam, upright wall, or other support surface in a room. The industrial ionizer 300 is particularly helpful in poultry (chicken) houses to purify and dedust the air and decrease ammonia in the poultry house in order to improve the health, comfort, well-being and longevity of chickens, turkeys, ducks and other poultry. In some circumstances, it may be desirable to use more the one industrial ionizer.

Figure 11:
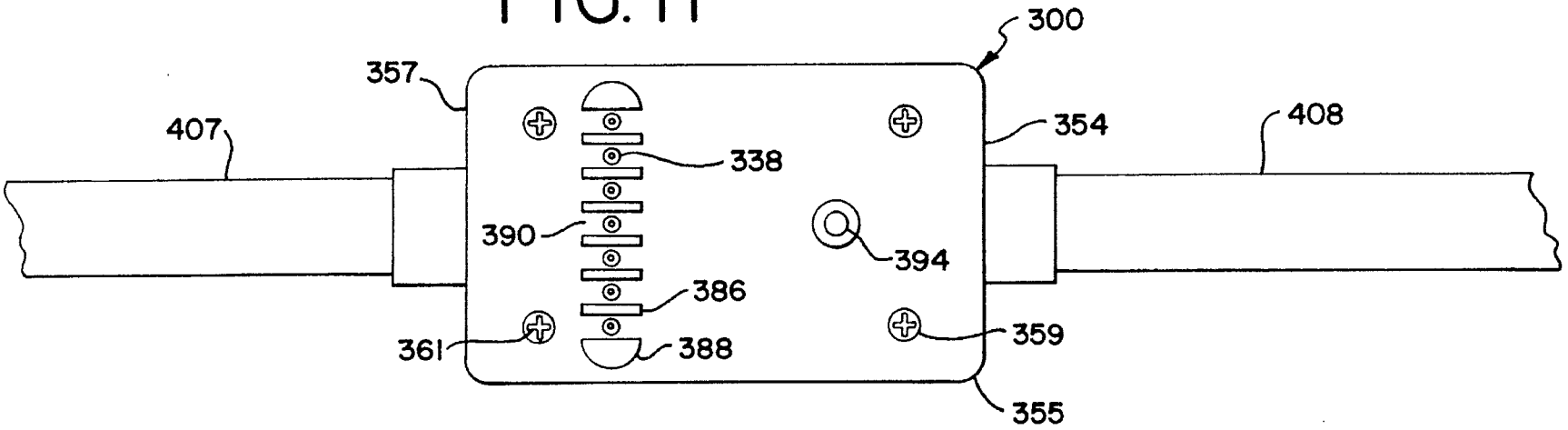
FIG. 11 is a front view of the industrial ionizer with adjacent conduits.
Figure 12:
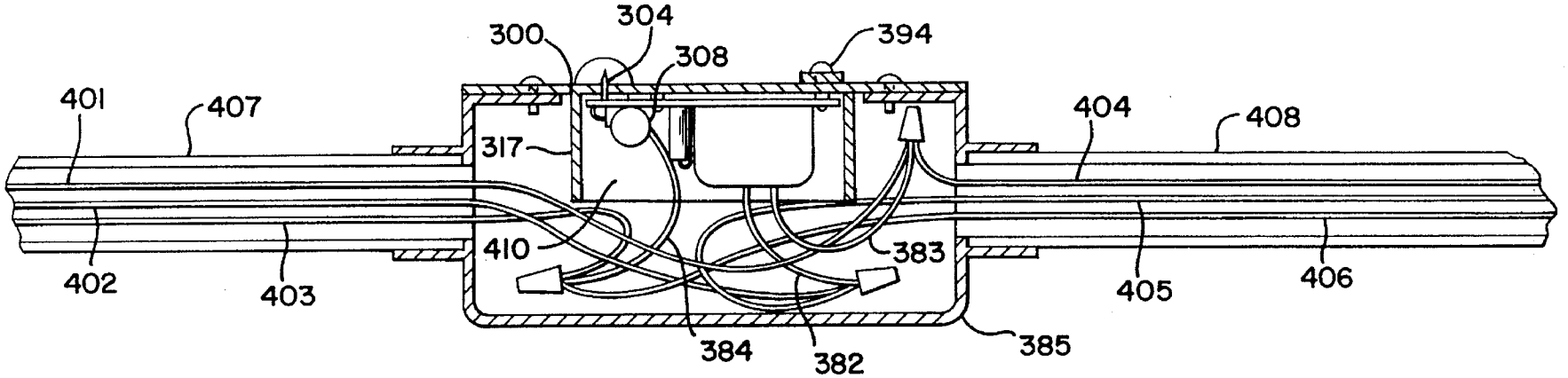
FIG. 12 is a cross-sectional side view of the industrial ionizer with a potting compound; the industrial ionizer being fastened to an electrical junction box which is secured to the conduits.

The sootless industrial ionizer 300 has an ion emission assembly 302 (FIG. 9) which emits negatively charged ions to ionize air, ammonia, and airborne particulates of dust and other pollutants in an area or room. The ion emitting assembly 302 comprises a set, series, and array of ion emitters 304 comprising of ion emitting metal ionizing needles. The needles can be gold or nickel plated and/or made of stainless steel. The needles 304 are secured to, supported by and cantilevered from a circuit board 306. The needles 304 can be electrically connected to an electric drive circuit 308 mounted on the circuit board. The electric drive circuit cyclically applies a negative potential charge to the needles 304 at a sufficiently high voltage to ionize the air, ammonia, dust and other airborne pollutants without substantially generating ozone. The electric drive circuit as described below provides an ionization device and apparatus that reduces or eliminates ammonia gases in agricultural and industrial applications, which provides a healthier and safer working environment. As shown in FIGS. 9 and 12, overhead exterior electrical wires 382–384 extend from the electrical circuit and the circuit board is connected to conventional wiring 401–406 (FIG. 12) in an electrical junction box 385 of a ceiling or wall. Overhead wires can be positioned within the interior of polyvinyl chloride (PVC) plastic conduits 407 and 408 (FIGS. 11 and 12).

The box-like housing assembly 314 of the industrial ionizer provides a protective housing 315 which houses, conceals and at least partially encloses and supports the ion emission assembly. The housing can be made of an impact-resistant insulating plastic, such as acrylonitrile butadiene styrene (ABS) or other materials. The housing assembly has a horizontally extending cover 354 which provides a rectangular mounting plate with rounded corners 355. The mounting plate 354 has a generally planar or flat exterior surface 356 with a set of aligned ion emission apertures 338 (FIG. 8) providing needle-receiving holes about the tips of the needles. The housing has upright vertical sides 317 (FIG. 7) which provide a rectangular skirt. The sides 317 are positioned inwardly from the peripheral edges 357 of the mounting plate 354. The sides 317 extends upwardly from the mounting plate 354 and peripherally surrounds the ion emission assembly. Screws 361 (FIG. 11) or other fasteners can be inserted in screw holes 359 to securely mount the housing assembly to a plastic outlet junction box 385 which can then be mounted on a ceiling. Preferably, the ionizer can be filled to its sides 317 with an electrical grade potting compound 410.

A horizontal, longitudinal series, set and array of substantially parallel support ribs 386 and arcuate semicircular end ribs 388 extend outwardly and downwardly from the exterior surface of the mounting plate 354. When the industrial ionizer is mounted on a ceiling, the ribs are aligned substantially horizontally and are positioned adjacent the needles 304. The space between the ribs provide horizontal air channels 390 to channel and direct the flow of air past the needles and away from the ionizer and ceiling so as to substantially prevent the accumulation of debris, dirt, and soot comprising ionized particulates on the ceiling or wall. The ribs 386 and 388 provide needle guards to substantially prevent the needles from puncturing human fingers and hands. Desirably, the industrial ionizer 300 can have moisture resistant barrier 392 (FIG. 9), comprising a seal, gasket, or closed cell silicon rubber sponge positioned between the needles 304 and the mounting plate 354 in order to minimize water and moisture from contacting the electric circuit, such as when the industrial ionizer is hosed down in a chicken house, The industrial ionizer 300 has a visible red indicator light 394 connected to the electrical circuit. The electric drive circuit 308 for the industrial ionizer has a resistor R1 420 which is connected in series to a diode D1 422 and a capacitor C1 424. Resistor R1 420 is connected in parallel to resistor R3 426. A transformer TI 428 is connected in series to diode D1 422 and capacitor C2 430. The capacitor C2 430 is connected in series to diode D2 432, diode 434, capacitor C3 436 and resistor R2 438.

Among the many advantages of the plug-ionizers (PI-1) and (PI-2) and the industrial ionizers are:

1. Outstanding performance.
2. Superior quality.
3. Excellent air purification.
4. Beneficial to the environment.
5. Simple to install.
6. Easy to use.
7. Can be readily mass produced.
8. Cleaner living space.
9. A healthier environment for people and animals.
10. Superb removal of pollutants and contaminants.
11. Decrease of dust and dirt.
12. Good ammonia reduction.
13. Attractive.
14. Economical.
15. Reliable.
16. Efficient.
17. Effective.

Although embodiments of the invention have been shown and described, it is to be understood that various modifications and substitutions, as well as rearrangements of parts, components, and process steps, can be made by those skilled in the art without departing from the novel spirit and scope of this invention.

What is claimed is:

1. An ionizer, comprising:

ion emission means for emitting ions to ionize dust laden particles in a room;

housing means for at least partially enclosing and supporting said ion emission means;

cleaning means for substantially reducing the accumulation of ionized dust laden particles about said housing means;

wherein said cleaning means includes air ventilation means for circulating air past said ion emission means; and wherein said air ventilation means comprises air channeling means defining an exhaust area about said ion emission means for egress of air and an entrance area spaced away from said ion emission means for ingress of air, said exhaust area having a smaller cross sectional than said entrance area to increase the flow rate of air flowing from the entrance area to the exhaust area past said ion emission means.

2. An ionizer in accordance with claim 1 wherein said air channeling means includes rib means positioned in proximity to said exhaust area and said entrance area and adjacent said ion emission means.

3. An ionizer in accordance with claim 1 wherein said air ventilation means further includes air blower means comprising a motor positioned in said housing means and a fan operatively connected to said motor.

4. An ionizer in accordance with claim 1 comprising a plug-in ionizer with contact blades for removably plugging into an electrical wall outlet.

5. A plug-in ionizer, comprising:

ion emission means for emitting negatively charged ions to ionize dusty airborne particulates in a room, said ion emitting means comprising an array of ion emitting needles, a circuit board spaced rearwardly of said ion emitting needles, an electrical circuit mounted on said circuit board for cyclically applying a negative potential charge to said needles at a sufficiently high voltage to ionize the particulates without substantially generating ozone, and electrical contact blades connected to said electrical circuit and extending from said circuit board for plug in connection to an electrical wall outlet on an upright wall;

a housing assembly for at least partially enclosing and supporting said ion emission means, said housing assembly having an upper housing defining ion emission apertures about said needles and a lower housing for mounting adjacent the upright wall and secured to and supporting said circuit board;

a cover assembly having an upright cover with a generally planar exterior surface, a series of substantially parallel upright ribs extending outwardly and longitudinally from the exterior surface of said cover, and upper and lower portions extending laterally inwardly from said cover and ribs and secured to said upper housing; and said cover assembly and said housing assembly cooperating with each other to define an upwardly converging tapered air channel for directing flow of air upwardly past said needles, said ribs being positioned substantially vertically and adjacent said needles for enhancing upward flow of air and providing a needle guard to substantially prevent the needles from puncturing a human fingers, said upper housing having a front surface comprising an air deflector, said air deflector having an elongated slanted portion extending upwardly and outwardly and a concave arcuate upper portion for directing the ions and air away from the ionizer and wall to substantially reduce the accumulation of soot comprising ionized particulates on the wall.

6. A plug-in ionizer in accordance with claim 5 wherein said ribs include upper set of ribs extending upwardly from said cover and a lower set of ribs extending downwardly from said cover and lower sets of ribs, and said upper and lower sets of ribs being vertically spaced from each other.

7. A plug-in ionizer in accordance with claim 5 including:

an air blower assembly for drawing air into the air channel, said air blower assembly comprising a DC motor spaced from said circuit board and positioned in said housing assembly and a blower wheel comprising a fan operatively connected to said motor and positioned in the air channel;

said cover assembly defines an intake opening about said fan;

a filter positioned between said fan and said intake opening; and said ribs comprise substantially vertical elongated ribs.

8. An industrial ionizer, comprising:

ion emission means for emitting negatively charged ions to ionize airborne particulates of dust in an area, said ion emitting means comprising an array of ion emitting needles, a circuit board secured to and supporting said ion emitting needles, an electrical circuit mounted on said circuit board for cyclically applying a negative potential charge to said needles at a sufficiently high voltage to ionize the particulates without substantially generating ozone, and electrical wires connected to said electrical circuit and extending from said circuit board for connection within an electrical box mounted to a ceiling or wall;

a housing assembly for at least partially enclosing and supporting said ion emission means, said housing assembly having a horizontally extending cover providing a mounting plate with a generally planar exterior surface defining ion emission apertures about said needles and a skirt extending upwardly from said plate and peripherally surrounding said ion emission means, and mounting means for securing said housing assembly to the electrical box; and an array of substantially parallel ribs extending downwardly from the exterior surface of said plate, said ribs being positioned substantially horizontally and adjacent said needles to define air channels for channeling and directing the flow of air past said needles away from the ionizer and ceiling to substantially prevent the accumulation of ionized particulates on the ceiling.

9. An industrial ionizer in accordance with claim 8, wherein said ribs comprise a needle guard to substantially prevent the needles from puncturing a human finger.

10. An industrial ionizer in accordance with claim 8 including a visible indicator light connected to the electrical circuit.

11. An industrial ionizer in accordance with claim 8 wherein said industrial ionizer is positioned in a poultry house or animal house and said ion emission means includes ionization means for substantially reducing or eliminating airborne ammonia gases in agricultural or industrial environments to help keep poultry or other animals healthier.

12. An industrial ionizer in accordance with claim 8 including:

a moisture barrier positioned between said needles, said moisture barrier being selected from the group consisting of a seal, gasket, and closed cell silicon rubber sponge barrier; and said skirt comprises a substantially rectangular skirt.

* * * * *